United States Patent [19]

Ness

[11] Patent Number: 4,651,159

[45] Date of Patent: Mar. 17, 1987

[54] MICROSTRIP ANTENNA

[75] Inventor: John B. Ness, Pullenvale, Australia

[73] Assignees: University of Queensland; Commonwealth of Australia, both of Queensland, Australia

[21] Appl. No.: 699,309

[22] Filed: Feb. 7, 1985

[30] Foreign Application Priority Data

Feb. 13, 1984 [AU] Australia ..... PG3596

[51] Int. Cl.[4] ..... H01Q 1/38

[52] U.S. Cl. ..... 343/700 MS; 343/830

[58] Field of Search ..... 343/700 MS, 846, 829, 343/830

[56] References Cited

U.S. PATENT DOCUMENTS 4,160,976 7/1979 Conroy ..... 343/700 MS 4,366,484 12/1982 Weiss et al. ..... 343/700 MS 4,477,813 10/1984 Weiss ..... 343/700 MS 4,516,129 5/1985 Ittipiboon et al. ..... 343/785

*Primary Examiner*—Eli Lieberman

*Attorney, Agent, or Firm*—Schwartz, Jeffery, Schwaab, Mack, Blumenthal & Evans

[57] ABSTRACT

A circularly polarized microstrip antenna for microwaves has a two layer substrate with a first layer of dielectric material spaced above the ground plate by an air gap comprising the second layer of the substrate, so arranged that the effective dielectric constant of the substrate in the range of 1.25 to 1.4 (for an infinite ground plane) and 1.25 to 1.6 (for a finite ground plate).

The preferred values of the effective dielectric constant are respectively 1.3 and 1.5 for the infinite and finite ground plane forms of the antenna.

8 Claims, 5 Drawing Figures

MICROSTRIP ANTENNA

BACKGROUND OF THE INVENTION (1) Field of the Invention

This invention relates to a circularly polarised microstrip antenna for microwaves.

(2 ) Prior Art

Short range mobile microwave links often use circularly polarised signals to minimise the effects of multipath interference. Because of their lightweight and flat profile, microstrip antennas are prime candidates for these applications. However, the axial ratio of conventional circularly polarised microstrip antennas deteriorates rapidly for scan angles greater than 30° to 100°.

For many applications, the methods of achieving good axial ratio out to wide scan angles by empirically adjusting the ground plane size or by using a corrugated ground plane are not practical. Furthermore, while the bandwidth of a typical path antenna is adequate for the transmission of TV signals, it usually permits the antenna to be used for only one or two channels. The only method for adjusting the resonant frequency of a conventional patch antenna for a given substrate is to change the size of the patch.

For the substrates, the field patterns of a circular disc antenna can be calculated. For a conventional "Teflon" (registered trade mark) fibreglass substrate antenna ($E_r$=2.55) the 3dB beamwidths of the E and H plane field patterns are 52° and 40°. If air is the substrate ($E_r$=1) the E and H plane 3dB beamwidths are 30° and 36° respectively. These results suggest that for an intermediate dielectric constant substrate, the E and H plane 3dB beamwidths should be approximately equal. Experiments have shown this to be correct and it has been found that the axial ratio is much better at wide scan angles (i.e. greater than 40° for a dielectric constant within the range of approximately 1.25 to 1.4 (i.e. $1.25 < E_r < 1.4$). However metal clad substrates with dielectric constants in this range are not readily available although expensive honeycomb material may be obtained.

SUMMARY OF THE PRESENT INVENTION

It is an object of the present invention to provide a circularly polarised microstrip antenna which has a good axial ratio out to wide scan angles.

It is a preferred object to provide such an antenna which permits a good degree of tuning.

It is a further preferred object to provide such an antenna which can be easily analysed and where a circular patch is used so that the axial ratio is independent of the angle of rotation about the patch.

Other preferred objects of the present invention will become apparent from the following description.

In one aspect the present invention resides in a circularly polarised microstrip antenna wherein the substrate comprises a multiple (e.g. two) layer dielectric wherein the effective dielectric constant ($E_r$) of the substrate falls within the range of 1.25 to 1.4.

In a second aspect the present invention resides in circularly polarised microstrip antenna wherein the substrate includes two layers, the first layer comprising dielectric material being spaced from the ground plate by an air gap comprising the second layer, so arranged that the effective dielectric constant of the substrate is in the range of 1.25 to 1.4.

Preferably the effective dielectric constant is approximately 1.3.

Preferably the antenna has an infinite ground plane i.e. the diameter of the ground plane is greater than twice the wavelength of the microwaves.

In a third aspect the present invention resides in a circularly polarised microstrip antenna wherein the substrate includes two layers, the first layer comprising dielectric material being spaced from the ground plate by an air gap comprising the second layer; so arranged that the ground plane is finite, the diameter of the ground plane not being greater than twice the wavelength of the microwaves; and the effective dielectric constant of the substrates in the range of 1.25 to 1.6.

Preferably the effective dielectric constant is approximately 1.5.

The dielectric material may comprise Teflon ® fibreglass, fibreglass or other suitable material and may be spaced from the metal ground plate or disc by the sheaths around the feeder lines and/or by the grounding pin. The distance between the dielectric material and the ground plate can be varied, to vary the air gap, to enable the antenna to be tuned.

BRIEF DESCRIPTION OF THE DRAWINGS

To enable the invention to be fully understood, a preferred embodiment will now be described with reference to the accompanying drawings, in which:

Referring to FIGS. 1 and 2, the conventional antenna 10 has a circular metal patch 11 (of diameter D) on the top of a substrate 12 (e.g. of Teflon ® fibreglass) with a thickness H and a dielectric constant $E_r$. A shorting pin 13 connects the patch 11 to a ground plate 14. Feedlines 15, 16 connect the patch 11, at right angles to a source of microwaves (not shown).

Figure 1:
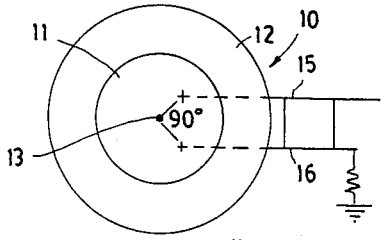
FIG. 1 is a plan view of a conventional antenna.
Figure 2:
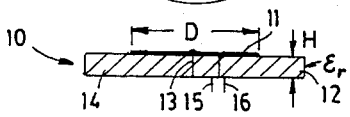
FIG. 2 is a side view corresponding to FIG. 1.
Figure 3:
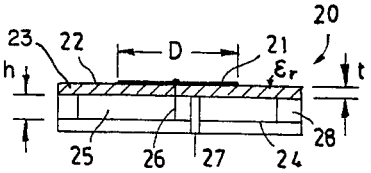
FIG. 3 is a side view of the antenna of the present invention (which has a similar plan view to that shown in FIG. 1)

Referring now to the invention of FIG. 3, the antenna 20 has a circular metal patch 21 (also of diameter D) on the substrate 22 which is composed of two layers. The upper layer of the substrate comprises a layer of dielectric material 23 (e.g. of Teflon ® fibreglass) with a thickness t (which is less than the thickness H of the substrate 12 of the known antenna). The dielectric material 23 is spaced above the metal ground plate 24 by an air gap 25 of thickness h. The spacing is maintained by a shorting pin 26 interconnecting the patch 21 to the ground plate 24 and by the sheath around the feedlines 27 which are again spaced 90° apart (as for the feedline 15, 16 in FIG. 1). The edges of the dielectric material 23 may be supported by spacer blocks or pins 28 of suitable plastics or other material.

The thickness h of the air gap 25 is selected so that the effective dielectric constant of the two layer substrate 22 is in the range of 1.25 to 1.4 (i.e. $1.25 < E_{ff} < 1.4$), with the effective dielectric constant being $E_{ff} + 1.3$.

Figure 4:
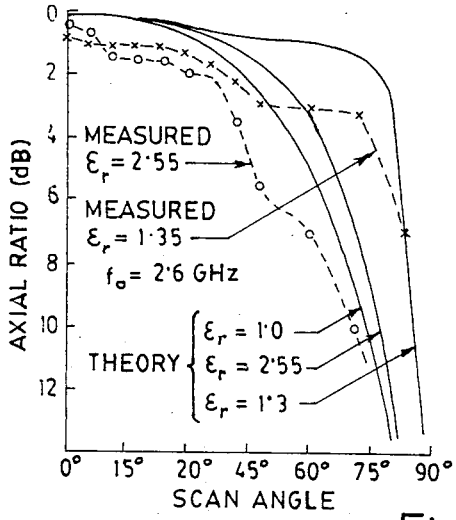
FIG. 4 is a graph of the axial ratio as a function of scan angle for various substrates (the theory assuming an infinite ground plane)

Referring to the graph of FIG. 4 it is noted that the axial ratio (measured in dB) falls markedly when the scan angle is approximately 40°–45° when the dielectric constant of the substrate $E_r=1.0$ (for air), and $E_r=2.55$ (for Teflon® fibreglass), the measured curve for $E_r=2.55$ falling even more sharply than the theoretical curve (where the ground plane is infinite). However, when the dielectric constant $E_r=1.3$, the theoretic curve only falls markedly at scan angles of approximately 80°-85°. The measured curve for the present invention, where the effective dielectric constant $E_{ff}=1.35$ shows that the axial ratio only falls markedly at a scan angle of approximately 75° (The corresponding drop is at approximately 35°-40° for the measured curve for the substrate having a dielectric constant $E_r=2.55$). This clearly shows that the antenna of the present invention can be effectively used over much wider scan angles than for the conventional antenna.

Figure 5:
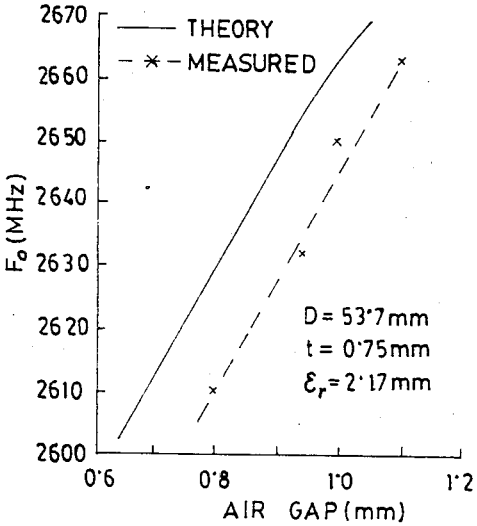
FIG. 5 is a graph of resonant frequency as a function of air gap height (with the effective dielectric constant in the range $1.25 < E_{ff} < 1.4$.)

Referring now to FIG. 5, the effective dielectric constant remains in the range $1.25<E_{ff}<1.4$ and so the linear measured curve indicates that the axial ratio remains substantially unchanged.

The embodiment described with reference to FIG. 3 and the graphs of FIGS. 4 and 5 assume that the antenna 20 has an infinite ground plane i.e. the diameter of the ground plane is greater than twice the wavelength of the microwaves. For microwaves of 2 $GH_z$, the diameter would be greater than 300 mm. Where the antenna is mounted e.g. on the roof of a vehicle or below a helicopter for air-to-ground communication, this is easily effected.

However, in certain applications e.g. in ground-to-ground military communications, physical limitations may require that the diameter of the ground plane be less than twice the wavelength of the microwaves.

In such applications, where the ground plane is finite, experiments have produced best results when the effective dielectric constant ($E_r$) of the substrate is approximately 1.5.

It will be readily apparent to the skilled addressee that the antenna of the present invention has the following features:

(a) it provides a good axial ratio to wide scan angles;
(b) the method of estimating the effective dielectric constant enables conventional equations to be used for calculation of the antenna parameter;
(c) the antenna can be set for different frequencies or tuned to compensate for substrate and etching tolerances;
(d) the antenna is effective over a wider range of frequencies; and
(e) the antenna can be inexpensively manufactured, the additional cost over known antennas being greatly outweighed by the improved performance.

Various changes and modifications (e.g. in materials and dimensions) may be made to the embodiments described without departing from the scope of the present invention as defined in the appended claims.

I claim:

1. A circularly polarized microstrip antenna comprising:

a ground plane formed of a conductive material;
a conductive patch positioned parallel to the ground plane and spaced therefrom;
a multiple layer dielectric means positioned between the ground plane and the metal patch, wherein the effective dielectric constant of the multiple layer falls within the range 1.25 to 1.4;
the conductive patch being electrically connected, at approximately the center of the patch, to the ground plane; and
two feed points connected to said conductive patch, said feed points being positioned orthogonally with respect to the center connection.

2. A circularly polarized microstrip antenna as claimed in claim 1 wherein said multiple layer dielectric means includes two layers, the first layer comprising dielectric material spaced from the ground plane by an air gap comprising the second layer, so arranged that the effective dielectric constant of said multiple layer dielectric means is in the range of 1.25 to 1.4

3. An antenna as claimed in claim 1 wherein the effective dielectric constant is approximately 1.3.

4. An antenna as claimed in claim 2 wherein the distance between the dielectric material and the ground plane is varied, to vary the air gap, to enable the antenna to be tuned.

5. An antenna as claimed in claim 2 wherein the ground plane is infinite, having a diameter greater than twice the wavelength of the microwave.

6. A circularly polarized microstrip antenna comprising a multiple layer dielectric means having two layers, the first layer comprising dielectric material spaced from a ground plane by an air gap comprising the second layer; said dielectric means being so constructed and arranged that the ground plane is finite, the diameter of the ground plane is greater than twice the wavelength of the microwaves, and the effective dielectric constant of said multiple layer dielectric means is in the range of 1.25 to 1.6.

7. An antenna as claimed in claim 6 wherein the effective dielectric constant is approximately 1.5.

8. An antenna as claimed in claim 6 wherein the distance between the dielectric material and the ground plane is varied, to vary the air gap, to enable the antenna to be tuned.

* * * * *